United States Patent [19]

Svensson

[11] 4,012,182

[45] Mar. 15, 1977

[54] MACHINES FOR ENERGY CONVERSION

[76] Inventor: Gosta Svensson, Sandelsgatan 23 B, 115 33 Stockholm, Sweden

[22] Filed: Nov. 12, 1975

[21] Appl. No.: 631,406

[30] Foreign Application Priority Data

Nov. 26, 1974 Sweden ..... 7414821

[52] U.S. Cl. ..... 418/153; 418/156; 418/221; 418/222; 418/234

[51] Int. Cl.[2] ..... F04C 1/00

[58] Field of Search ..... 418/152, 153, 154, 155, 418/156, 221, 222, 234

[56] References Cited

UNITED STATES PATENTS

| | | | |
|---|---|---|---|
| 637,429 | 11/1899 | Theemling | 418/222 X |
| 707,174 | 8/1902 | Stanley | 418/222 |
| 889,426 | 6/1908 | Arons | 418/222 X |
| 897,519 | 9/1908 | Bonner | 418/221 X |
| 2,395,092 | 2/1946 | Bertoglio | 418/221 X |
| 2,573,819 | 11/1951 | Weyer | 418/155 |

FOREIGN PATENTS OR APPLICATIONS

| | | | |
|---|---|---|---|
| 803,878 | 4/1951 | Germany | 418/156 |

*Primary Examiner*—Carlton R. Croyle
*Assistant Examiner*—Leonard Smith
*Attorney, Agent, or Firm*—Karl W. Flocks

[57] ABSTRACT

A machine for energy conversion includes a working chamber defined by two relatively movable parts and provided with inlets and outlets for the working medium, both parts having members serving as pistons and abutments which sealingly engage with the walls of the working chamber. The members serving as pistons and abutments may pass through each other and consist of a number of juxtaposed elements which laterally seal against each other and against adjacent portions of the wall of the working compartment and have variable surface area to permit passage.

11 Claims, 9 Drawing Figures

MACHINES FOR ENERGY CONVERSION

The present invention relates to an improved machine for energy conversion which includes two relatively movable parts defining a working chamber provided with inlets and outlets for the working medium, and in which both of the parts display members extending into the working chamber and serving as pistons and abutments, these members being arranged to sealingly engage the walls of the opposed and cooperating parts defining the working chamber, and at least the member or members associated with the one part are so designed as to permit passage of the member or members associated with the opposed part.

The ability to convert energy in gases and liquids to a suitable form of mechanical work has been of basic importance for industrial development. Many different types of machines have been developed for such energy conversion and for the reverse process. In accordance with the basic principle for their mode of operation, these machines can be divided into a number of groups, such as piston engines, turbines and vane-type machines. These are used int.al. in the field of pneumatics as motors and compressors, in the field of hydraulics as motors and pumps and as combustion engines and vapour motors.

It is generally desirable that, for rotary energy converters, the ratio between their effect and their size be as high as possible. The effect of a rotary machine is the product of the torque and the speed. Rotary motion piston engines have relatively low effect in relation to their size partly because their speed is restricted as the acceleration and deceleration forces deriving from the motion of the piston cause great wear and vibration problems at high speed and partly because the balancing devices and the transmission mechanism between the reciprocating and rotating parts require a great deal of space. As a rule, turbines have a high speed but a rather low torque. Vane-type motors have a relatively high effect in relation to their size. However, the eccentricity and consequently the torque is greatly restricted for reasons of construction and the speed is restricted because the friction effect between the vanes and the cylinder increases very rapidly with increasing speed.

A description follows a new basic principle for energy conversion which may be used within many fields partly because it provides for a considerably higher effect in relation to the size of the machine than do previously used energy conversion principles.

According to the invention, the members associated with the two relatively movable parts and dividing the working chamber have portions which extend into the working chamber, are arranged to pass through each other, and include a number of juxtaposed elements which are arranged to laterally engage each other and the walls of the working chamber in sealing fashion, while having a surface area variable transversely of the direction of relative movement for permitting passage of elements disposed on the members of the opposed part.

An embodiment of the improved machine will be described in greater detail hereinbelow with reference to the accompanying drawing, in which.

Figure 1:
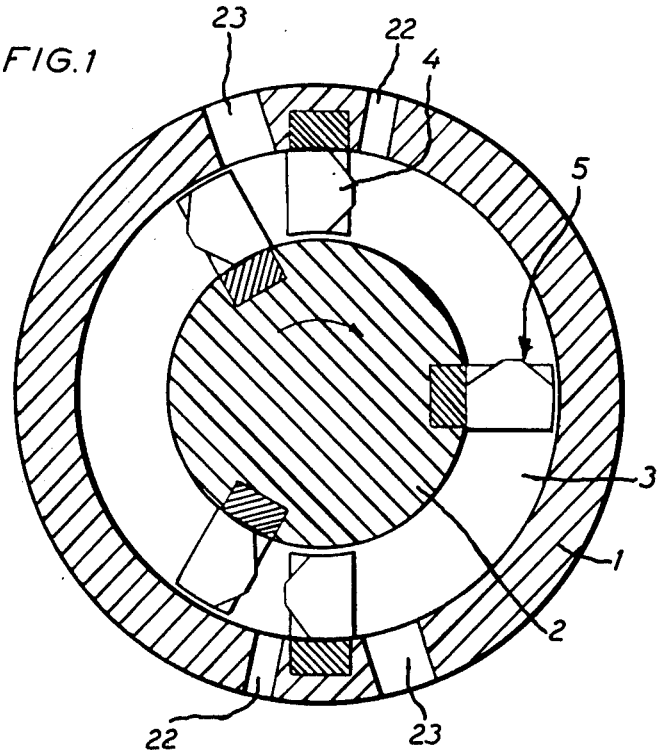
FIG. 1 shows, in partial section, a machine for energy conversion including the device according to the invention.
Figure 2:
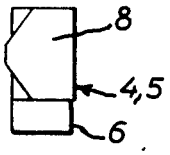
FIG. 2 is a side elevation of a so-called gate means included in the device according to the present invention and dividing up the working chamber.
Figure 3:
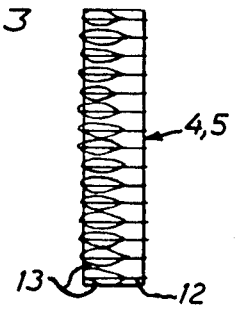
FIG. 3 is a top plan view of a gate means comprising a plurality of so-called gate elements.
Figure 4:
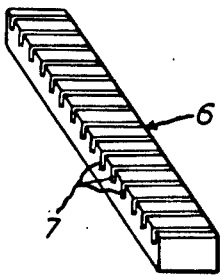
FIG. 4 is a perspective view of a retainer bar of the gate means.
Figure 5:
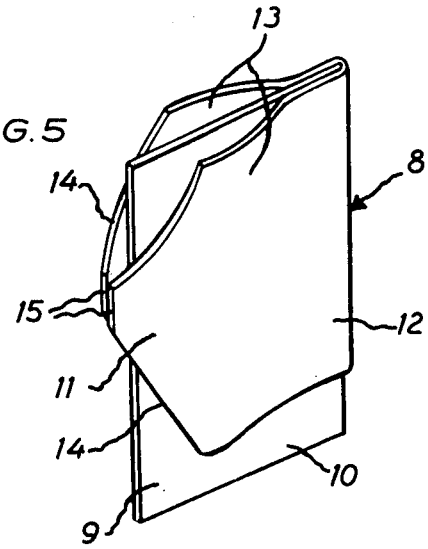
Figure 9:
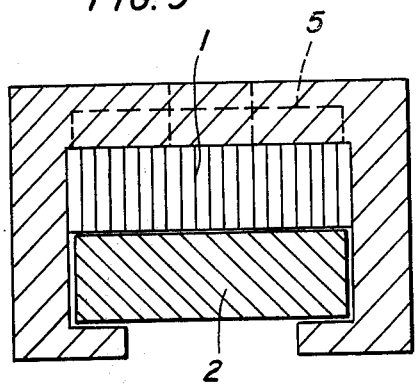
Figure 6:
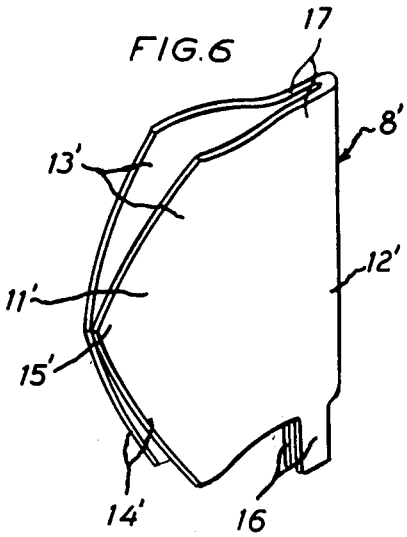
Figure 7:
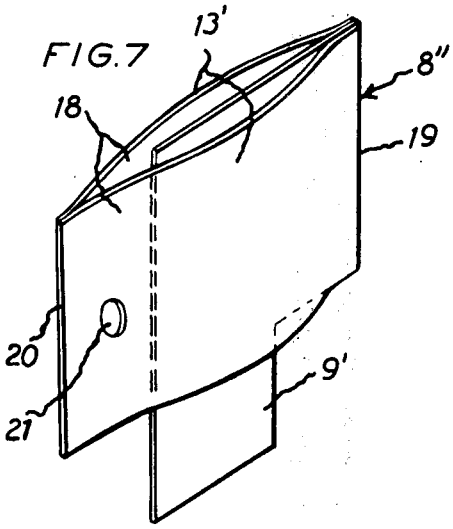
Figure 8:
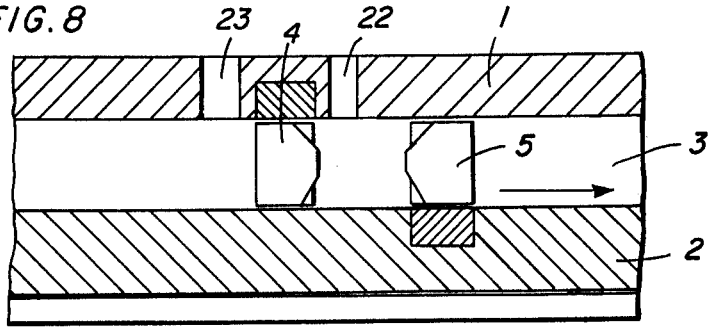

FIG. 5 on a larger scale shows one of the basic elements of FIGS. 1 and 2 as seen obliquely from the side;

FIG. 6 shows a modified embodiment of a gate element as seen obliquely from the side;

FIG. 7 shows a further modified gate element as seen obliquely from the side;

FIG. 8 shown the device according to the invention used in a machine with a straight working chamber; and FIG. 9 shows the machine of FIG. 8 in cross-section.

The device shown in FIG. 1 consists of a suitably stationary outer portion 1 with an annular recess formed therein, and a suitably rotary inner portion 2 which is designed such that it defines, together with the portion 1, an annular chamber 3 of substantially rectangular cross-section, this chamber forming the working chamber.

So-called gate means 4 and 5 serving as abutments and pistons, respectively, are fixed on both the outer portion 1 and the inner portion 2 and project inwardly from either direction into the annular chamber 3. The gate means which are so arranged as to prevent passage of the working medium can pass each other.

The gate means at the outer and inner portions are of substantially identical design but are mutually offset in the axial direction.

A gate means 4 or 5 may consist of a retainer bar or the like 6 which is provided with a number of grooves 7 and a number of gate elements 8, 8′ and 8″ respectively.

As is apparent from the drawing, the gate elements can be designed in different ways. In the embodiment shown in FIG. 5, the gate element consists of a rigid plate 9 whose end 10 is for insertion and fixation in a groove 7 in the retainer bar 6, and a doubled plate 11 of thin resilient material fixed to the above-mentioned plate 9 adjacent the folding edge 12. The flank portions of the doubled plate 11 diverge from the folding edge 12 and merge into abutments or sealing portions 13 outwardly arched in opposite directions and, in turn, merging into converging end portions. The free edges 14 of the end portions are obliquely cut, and the resulting tips 15 abut against each other because of the arching.

The portions between the tips 15 and the folding edge 12 connected to the rigid plate 9 will be spaced apart from each other and from the plate 9 because of their shape but can be compressed towards the plate against the action of the inherent resilience of the material.

The embodiment according to FIG. 6 differs from that described above primarily in that the rigid plate 9 has been dispensed with. Instead, projections 16 are provided at one edge of the doubled plate 11′ and are intended to be inserted and retained in the grooves 7 of the retainer bar 6. Otherwise the design of the plate 11′ corresponds substantially to that of the plate 11. The flank portions may, along the region 17 in immediate proximity of the folding line, abut against and suitably be connected to each other by welding or soldering. Moreover, the flank portions are, as in the previous embodiment, outwardly arched so that abutment or sealing portions 13' are formed and the tips 15' resulting from the oblique cutting of the free edges 14' are intended to abut against each other.

The embodiment according to FIG. 7 differs from those already described in that the doubled plate in element 8'' is replaced by a pair of plates 18 of thin resilient material which are mutually connected at both extreme edges 19, 20 respectively. A substantially L-shaped rigid plate 9' is mounted between the plates 18 and is connected to the plates 18 forming the gate element 8'' adjacent the edge 19, and is fixable in a groove in the retainer bar 6.

If the apparatus is used as a motor, a recess 21 can be provided in at least one of the plates 18 adjacent the edge 20 which in the prevailing rotation direction will be the trailing one. The object of the recess is to allow the working medium to pass inside the plates 18 in order that they can be separated under the influence of the medium, so that the abutment portions 13'' abut harder against corresponding portions of the juxtaposed gate element on the same retainer bar. If the apparatus is used as a compressor or a pump, the recess should instead be provided adjacent the edge 19. If the apparatus is used as a reversible motor, pump or compressor, recesses should be provided both adjacent the edge 19 and adjacent the edge 20. In this latter case, the gate elements should also have a valve function.

The retainer bars 6 of the gate means provided at the outer portion 1 and at the inner portion 2 are designed such that the gate elements will be axially offset in relation to each other such that the grooves 7 in the retainer bars of one part are located midway between the grooves of the retainer bars of the other part. This implies that the folding edges of the gate elements at the gate means of one of the parts will be located between the folding edges of the gate means of the other part.

Upon relative rotation of the parts 1 and 2, the folding edges 12, 12' and the edge 19 of the gate means of the respective parts will be able to enter between each other. Because of the fact that the flank portions of the gate elements are resilient and can be bent against each other or against the rigid plates 9, 9' respectively, the elements can be compressed in the axial direction sufficient to pass each other. As soon as two gate means have passed each other the lateral portions will spring back into place and the outwardly facing abutment portions 13, 13' and 13'', respectively, at juxtaposed gate elements will come into sealing abutment with each other.

The gate means are intended to be oriented in relation to the prevailing rotation direction such that the folding edges 12 and 12', respectively, in the embodiments according to FIGS. 5 and 6 and the edges 19 in the embodiment according to FIG. 7 will move towards each other. Since the pressure of a working medium will also act on the inner surface of the plates 8, 8' and 18, respectively, the working medium pressure will amplify the force with which the flank portions of adjacent elements will be kept in abutment against each other.

In actual fact, the same effect could be achieved if the gate elements were V-shaped with the folded edges meeting each other. An apparatus of such a design could, however, only be driven in one direction and but a slight rearward shift would result in damage to the gate means. The illustrated design, in which also the free edge portions and the opposite edges of the elements either lie in plough-like abutment or are connected to each other, provides for the possibility of rotation in both directions.

The embodiment of the machine shown in FIG. 1 has two gate means 4 serving as abutments and three gate means 5 serving as pistons. On either side of the first-mentioned gate means there are provided inlets 22 and outlets 23, respectively for the working medium. In view of the fact that the gate means at the inner part 2 serve as valves, the inlets and outlets can in principle be allowed to remain open. By arranging a switching valve at the inlet and outlet conduits, it is possible to make the machine rotate in the opposite direction. It has proved to be advantageous to provide an unequal number of gate means serving as abutments and as pistons — for example three piston members and two abutment members — since it is thereby possible to avoid dead centres and to realize a more even running of the machine. In the illustrated embodiment two piston members will be power-actuated even when one piston member passes an abutment member and is not actuated by the working medium.

Even though the machine has been described and shown as having an annular working chamber, it is obvious that the device according to the invention can also be used in machines with an arcuate or straight working chamber. The design of the gate elements in such machines need only differ in minor details from the illustrated gate elements and the function of them will be similar to that of the gate elements described above. However, it would seem that the device according to the present invention will be most useful in rotary machines.

The invention should not be considered as restricted to that described above and shown on the drawing but may be modified in a number of ways within the spirit and scope of the appended claims.

What I claim and desire to secure by Letters Patent is:

1. In a machine for energy conversion which includes two relatively movable parts defining a working chamber provided with inlets and outlets for a working medium, and in which both of said parts have members extending into said working chamber and serving as pistons and abutments respectively, said members being arranged to sealingly engage wall portions of the opposed and cooperating parts defining the working chamber, and at least said member or members of said one part are operative to permit passage of the member or members of the other part by being displaced transversely of the direction of relative movement, thus reducing its transverse area, the improvement that both of said members of said two relatively movable parts extend into the working chamber, divide the same and sealingly engage the wall portions defining said chamber, said members each include a number of juxtaposed elements engaging each other and/or the wall portions of the chamber in a sealing fashion, wherein each of said elements includes a pair of thin plate portions of resilient material engaging each other along at least one edge transverse to the direction of relative movement and wherein said plate portions in un-biased position diverge from the engaging edge and sealingly engage flank surfaces of adjoining elements of same member and/or chamber wall portion facing such flank surface, and in biased position, upon meeting cooperating elements of said member of the opposed part, being flexed towards each other, thus allowing the likewise flexed plate portions of said elements of said opposed part member to pass through.

2. Machine according to claim 1, wherein both of said parts may be linearly offset relative to each other, and wherein said working chamber is straight.

3. Machine according to claim 1, wherein the elements of the members associated with each respective part are mutually offset.

4. Machine according to claim 1, wherein said plate portions forming the thin elements consist of a doubled thin plate which, adjacent its bendable and pliable folding edge, is connected to a retainer means or the like mounted at each respective part, and wherein said plates, which are otherwise free, diverge from said bendable and pliable edge.

5. Machine according to claim 4, wherein the diverging portions of said double plate are extended by means of converging projections abutting against each other at the outer ends.

6. Machine according to claim 4, wherein said doubled plate is arranged to be supported and fixed at said retainer means by a thin rigid plate disposed between the flank portions.

7. Machine according to claim 4, wherein the doubled plate is provided adjacent the folding edge with projecting tongues arranged to form a mounting for the plate in said retainer means.

8. Machine according to claim 1, where the plate portions forming the thin elements of the members are connected to or engage each other along two opposed edges and diverge, from both edges, towards an outwardly-arched central portion, a rigid mounting being provided adjacent one edge for the fixation of the element in a retainer means provided at each respective part.

9. Machine according to claim 8, wherein at least one of both of the plate portions connected to each other is provided with a recess permitting inflow of working medium between said plate portions at one connecting edge.

10. Machine according to claim 1, wherein both of the relatively movable parts consist of relatively rotatable parts, and wherein said working chamber is annular.

11. Machine according to claim 10, wherein the connecting edges of the elements of the members dividing said working chamber extend substantially radially, and wherein said elements are compressible in an axial direction.

* * * * *